US005992198A

United States Patent [19]

Blangetti et al.

[11] Patent Number: 5,992,198

[45] Date of Patent: Nov. 30, 1999

[54] METHOD AND DEVICE FOR PRODUCING A TUBE IN A TUBE PLATE

[75] Inventors: Francisco Leonardo Blangetti, Baden, Switzerland; Harald Gerhard Fuchs, Lauchringen, Germany

[73] Assignee: Asea Brown Boveri AG, Baden, Switzerland

[21] Appl. No.: 09/206,321

[22] Filed: Dec. 7, 1998

[30] Foreign Application Priority Data

Dec. 10, 1997 [EP] European Pat. Off. ..... 97810965

[51] Int. Cl.[6] ..... B21D 26/02

[52] U.S. Cl. ..... 72/62; 72/58; 29/890.038; 29/890.043

[58] Field of Search ..... 29/890.038, 890.043, 29/890.044; 72/58, 62, 61

[56] References Cited

U.S. PATENT DOCUMENTS

| | | | |
|---|---|---|---|
| 4,387,507 | 6/1983 | Kelly | 72/58 |
| 4,502,308 | 3/1985 | Kelly | 72/62 |
| 4,694,677 | 9/1987 | Rabe | 72/890.044 |
| 4,761,981 | 8/1988 | Kelly . | |
| 4,901,551 | 2/1990 | Widart | 72/58 |
| 4,967,468 | 11/1990 | Vossbrinck et al. | 29/890.038 |
| 5,062,199 | 11/1991 | Kelly | 72/58 |

FOREIGN PATENT DOCUMENTS

| | | |
|---|---|---|
| 1527073 | 5/1968 | France . |
| 07124671 | 5/1995 | Japan . |
| 592840 | 11/1977 | Switzerland . |
| 1141239 | 1/1969 | United Kingdom . |

*Primary Examiner*—David B. Jones
*Attorney, Agent, or Firm*—Burns, Doane, Swecker & Mathis, L.L.P.

[57] ABSTRACT

In a hydraulic method, tubes (3) of an heat exchanger are rolled in in tube plates (1), and rounded tube inlet pieces are formed from the same tube (3) by means of the same device in the same work operation. For this purpose, the tubes (3) are inserted into the bores (2) of a tube plate (1) and cut off with an excess length. The tube (3) is widened by means of a widening machine over the entire depth of the bore (2), so that the tube (3) adheres to the inner wall of the bore (2). At the same time, the projecting tube end (10) is pressed on the mandrel (4) of the widening machine in the direction of the tube plate (1) by means of a further hydraulic shaping device (11) with a swept-back shape (12) until the tube end (10) achieves a trumpet shape. The advantage of the method resides in shortening the operating time with a device which executes both widening and formation of the tube inlet piece hydraulically. Given that the tube inlet piece is produced from the same tube (3), no seam is produced between the tube (3) and tube inlet piece, thus avoiding a site of faltering flow.

2 Claims, 2 Drawing Sheets

METHOD AND DEVICE FOR PRODUCING A TUBE IN A TUBE PLATE

BACKGROUND OF THE INVENTION

1. Field of the invention

The invention relates to a method and a device for producing tubes of a heat exchanger, in particular a preheater in a power plant, the tubes being rolled in hydraulically in a tube plate and a rounded tube inlet being formed.

2. Discussion of Background

In heat exchangers used in power plants, the tubes through which water flows are fixed in tube plates by means of rolling-in techniques. For this purpose, a tube is firstly placed into a bore of a tube plate, and the mandrel of the rolling machine is then inserted into the tube and widens the tube in a plastic fashion such that said tube adheres to the inner wall of the bore. As a rule, the rolling-in fixes and seals the tube by means of the adhesive forces between the bore wall and the tube outer wall. The tightness of the connection between the tube and tube plate is improved by welding, the welded seam serving only as a sealing seam and contributing nothing to the adhesive forces. Mechanical and hydraulic rolling-in techniques are presently distinguished. Mechanical rolling-in typically extends in this case over a depth of 20 to 30 mm, which is mostly smaller than that of the tube plate. Rolling-in over the entire tube plate depth is certainly possible using this method, but proves to be time-consuming and, with some tube materials, difficult. The hydraulic rolling method, as carried out, for example, by the Teco tube expanders company in Wuppertal, Germany, uses hydraulic widening of the tube instead of mechanical widening. This permits widening without any problem independently of the tube material, and the fastening of the tube over the entire tube plate depth, the resulting strength of the connection being increased. Furthermore, hydraulic widening over the entire tube plate depth permits the use of thinner and more cost-effective tube plates, since such a widening means that the tube wall thickness can be regarded as a bearing part in the tube plate.

In preheaters used in power plants, in particular in high-pressure preheaters, damage due to erosion at the tube inlet occurs relatively frequently. Such damage is rectified successfully by so-called inserts. These inserts, as described in British Patent 1,141,239, for example, are trumpet-shaped structures which are fixed at the tube inlet by tube widening and project slightly above the surface of the tube plate. The trumpet shape of the inlet piece of the tube is also known by the term "bellmouth inlet". The round shape of the insert favors the inflow by reducing the radial velocity gradients at the transition from the water chamber to the tube, as well as reducing the shear forces at the tube inner wall. The resistance values of the inflow in the case of such a tube inlet are discussed, for example, in I. E. Idelchick, Handbook of Hydraulic Resistance, page 126, 2nd Edition, Springer Verlag (1986). A low resistance value has the effect, on the one hand, of reducing the inflow pressure loss and, on the other hand, of sparing the oxide layer of the tube and generally reducing the erosion and corrosion of the tube. In addition, the tube inlet pieces are produced in each case from erosion- and corrosion-resistant materials. By projecting beyond the tube plate surface by a multiple of the tube outside diameter, the inserts further yield the advantage that a "water cushion" which strongly reduces the erosion of the tube plate is formed in the region of the inflow field. However, it is disadvantageous with such inserts that, because of the rolling-in in the region of the rolling-in site, a site of faltering flow which increases the risk of cleavage cracks and corrosion forming on the latter is formed at the seam between the insert and tube. Finally, the subsequent fastening of inserts occasions additional costs.

SUMMARY OF THE INVENTION

Accordingly, one object of the invention is to provide a novel method and device for producing hydraulically rolled-in tubes in tube plates with a rounded inlet tube piece, in which the rolling of the tube into the tube plate and the production of the tube inlet piece are fulfilled in a shortened, and thus more cost-effective, work operation, and by means of which sites of faltering flow are avoided and the risk of cleavage crack corrosion is minimized. According to the invention, this object is achieved by means of a hydraulic rolling-in method for tubes in tube plates of a heat exchanger, in which the hydraulic widening of the tubes and the formation of tube inlet pieces from the tubes themselves are combined into a single work operation. For this purpose, the tubes of a heat exchanger are firstly guided through the bores of a tube plate and are cut off at the inflow end with an excess length which is a multiple of the outside diameter of a tube. For the purpose of hydraulically widening a tube, the mandrel of a hydraulic widening machine is then inserted into the entire depth of the tube plate. By delivering a hydraulic pressure, the tube is widened until it adheres to the entire inner wall of the bore. At the same time, the tube end, the beaded head of the tube, is pressed hydraulically in the direction of the tube plate until the tube end achieves a predetermined rounded shape.

A first advantage of the method resides in that the widening and the formation of the inlet piece are carried out in a short operating time, and therefore cost-effectively. The time required for the entire method is only 8–10 seconds, and this is to be ascribed to the fact that the method is carried out purely hydraulically without further material pieces, and backward milling of the tube ends and the insertion and fastening of separate inserts are eliminated. A second advantage resides in the use of the same tube for producing the tube inlet piece. On the one hand, there is no need for an additional, prefabricated tube inlet piece, and on the other hand no seam is produced, and therefore no site of faltering flow, which would have to be carefully rounded off. The complete avoidance of a seam between the tube inlet piece and tube likewise circumvents the risk of cleavage cracks and corrosion resulting therefrom.

The device for carrying out the method comprises a device for hydraulically widening a tube, having a mandrel which is inserted into the tube and has a sealable pressure chamber and several ducts for filling in a pressure liquid. In particular, the device has a further shaping device which is set back a little from the mandrel end and arranged outside the tube end and externally has the rounded shape to be formed for the tube inlet piece. In turn, the shaping device includes a sealable pressure chamber with a filling-up duct for the pressure liquid, through which the shaping device is moved and the tube end is pressed into the predetermined shape.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
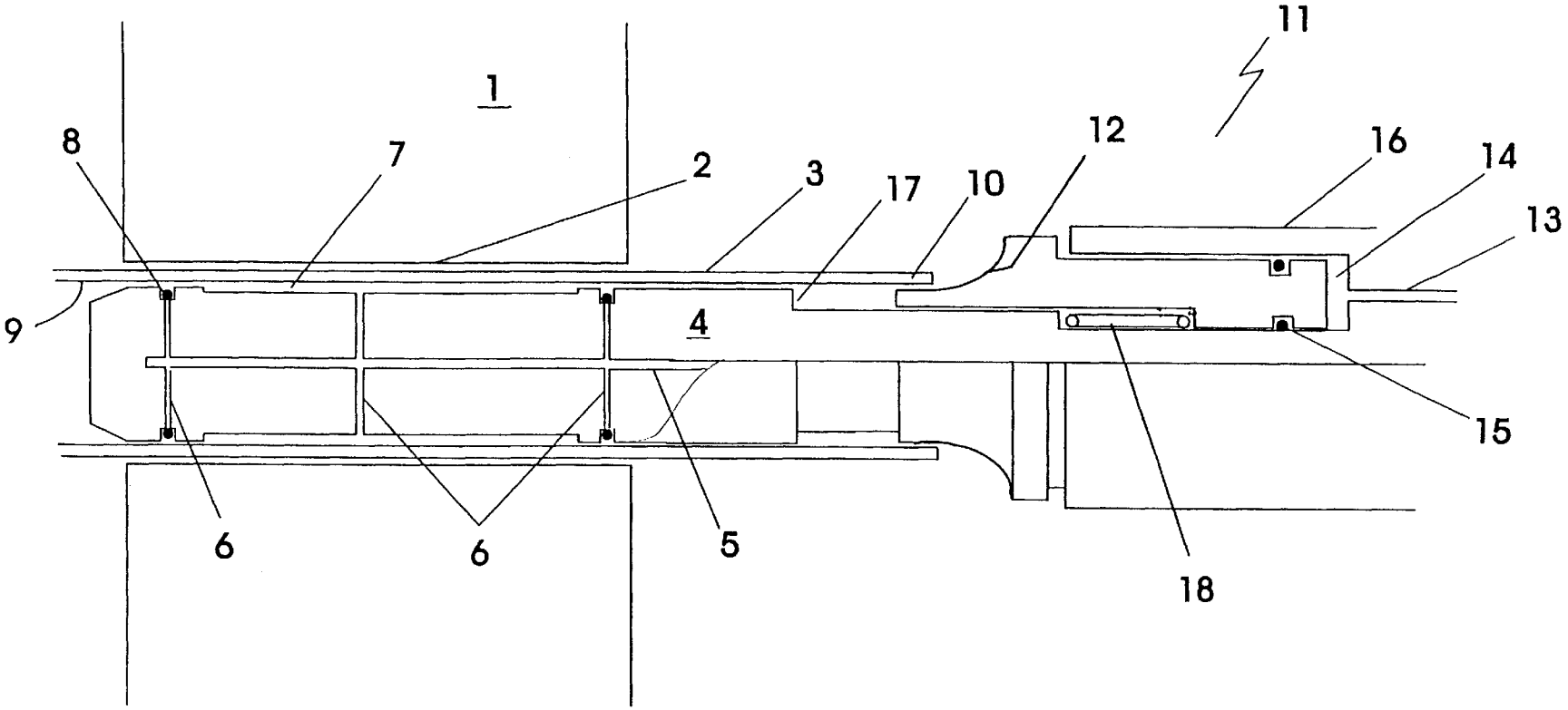
FIG. 1 shows a device, in cross section, for widening a tube and forming the tube inlet, with the tube not produced.
Figure 2:
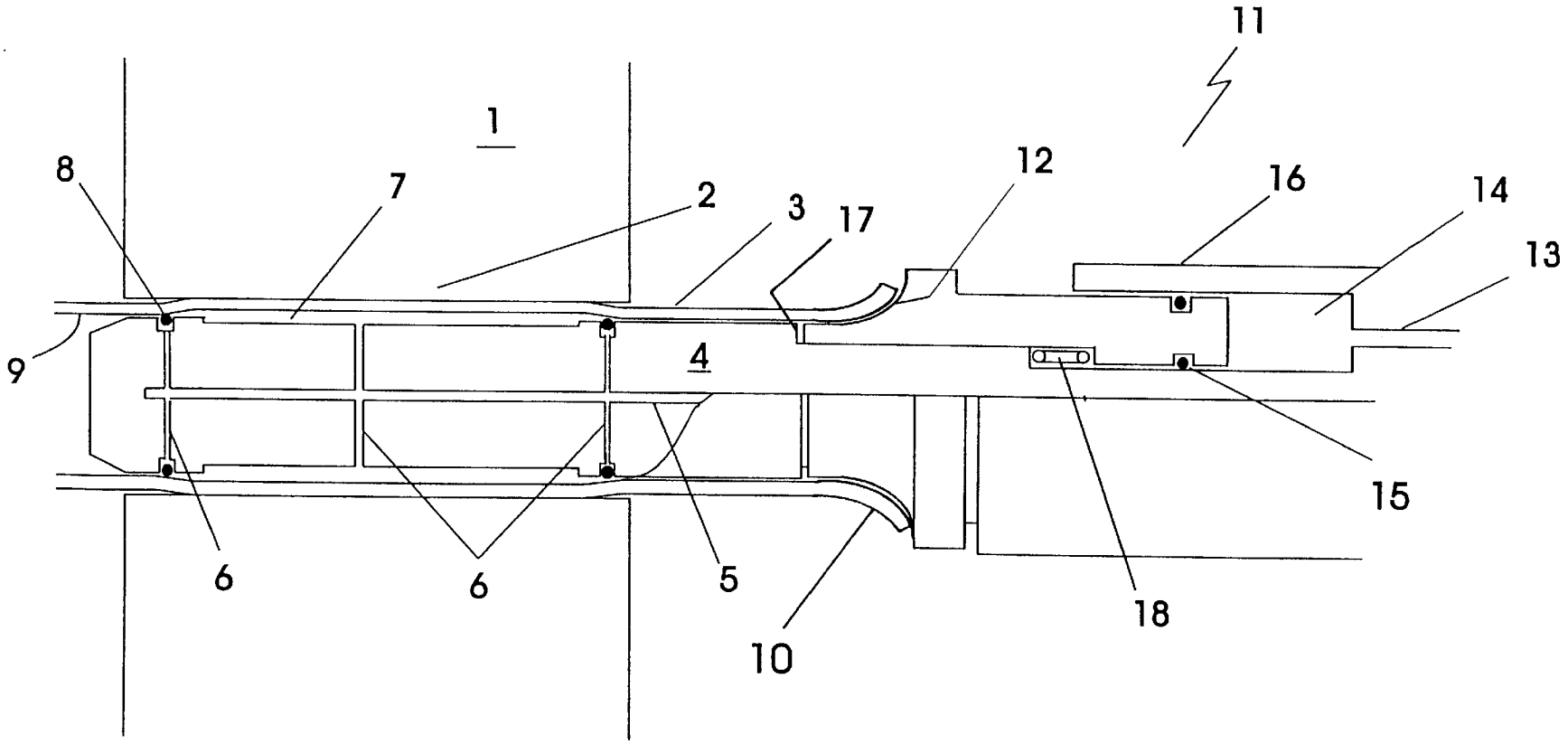
FIG. 2 shows the same device with the finished, rolled-in tube and a rounded, trumpet-shaped tube inlet.

Referring now to the drawings, wherein like reference numerals designate identical or corresponding parts throughout the several views, in FIG. 1 a tube plate 1 is shown with a bore 2 into which a tube 3 is guided. The device for producing the tube 3 has a mandrel 4 with a central filling-up duct 5 which leads from a liquid container (not illustrated), and three side ducts 6 for the hydraulic liquid. The middle side duct 6 leads from the central duct 5 into a narrow cavity 7 which is bounded by the mandrel 4 and the inner wall of the tube 3. The two outer ducts 6 lead in each case to an O-ring 8 which seals the cavity 7 between the mandrel 4 and the tube inner wall 9. Immediately outside the tube end 10, a shaping device 11 which slides on the mandrel 4 is arranged on the mandrel 4. On the side facing the tube end 10, it has a swept-back shape 12 which has the shape which is desired for the inside of the tube inlet. A duct 13 leads from a liquid container (not illustrated) to a cavity 14 for the hydraulic liquid. The cavity 14 is, in turn, sealed in an airtight fashion by O-rings 15 and a surrounding housing 16. The mandrel 4 further has a stop 17, which limits the free movement of the shaping device 11 in the direction of the tube plate 1. A restoring spring 18 is arranged between a further stop 19 and the O-rings 15 and, in its unloaded state, determines the rest position of the shaping device 11. In the method for fastening the tube 3 in the bore 2 and for producing the tube inlet, the tube 3 is firstly led through the bore 2 until a tube length projects above the surface 20 of the tube plate 1. The tube is then cut off with an excess length of two to four times the tube outside diameter. The mandrel 4 of the widening device is inserted into the entire depth of the tube plate 1. The cavities of the system, that is to say, therefore, the central duct 5, the three side ducts 6 and the cavity 7, which is bounded by the mandrel 4, the O-rings 8 and the tube inner wall, are filled with liquid are subjected to pressure for the purpose of hydraulically widening the tube 3. The O-rings 8 are spread apart in the process, thus sealing the cavity 7 in an airtight fashion. As soon as the tube 3 has been widened and adheres in the bore 2, pressure is built up for a second time in the cavity 14 of the shaping device 11. The effect of the pressure is to slide the shaping device 11 up to the stop 17, the beaded head, the tube end 10, being pressed in the direction of the tube plate. In the process, the tube end is given the trumpet shape in accordance with the swept-back shape 12. After the hydraulic pressure decays, the shaping device returns to its initial position again through the action of the restoring spring 18. FIG. 2 shows the completed rounded trumpet-shaped tube inlet with the device 11 on the stop 17. The work operation lasts a total of approximately 8–10 seconds. The radius of curvature of the trumpet shape of the tube inlet piece formed is preferably approximately ten percent of the inside diameter of the tube. In accordance with the calculations of Idelchick, such a curvature of the tube inlet leads to a resistance value for the inflow which is approximately four times smaller than that of a tube with sharp edges. After completion of the widening of the tube and formation of the trumpet shape, the edges of each tube inlet are deburred, in order to minimize eddies emanating from the edges.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A device for hydraulically widening tubes in bores in tube plates of a heat exchanger, comprising:

a mandrel for insertion into the tube;

a plurality of ducts disposed within the mandrel for transferring liquid for hydraulic widening of the tube;

a hydraulic activated shaping device slidably connected to said mandrel at one of its ends for forming trumpet-like shaped tube inlets at the tube end, wherein said shaping device has a swept-back shape.

2. The device of claim 1, wherein the swept-back shape has a radius of curvature which is more than four percent of the inside of the diameter of the tube.

* * * * *